US007930849B2

(12) United States Patent
Abraham et al.

(10) Patent No.: US 7,930,849 B2
(45) Date of Patent: Apr. 26, 2011

(54) ADJUSTABLE BUTT STOCK

(76) Inventors: Dick Abraham, Crystal Lake, IL (US); David M. Selvaggio, Barrington, IL (US)

( * ) Notice: Subject to any disclaimer, the term of this patent is extended or adjusted under 35 U.S.C. 154(b) by 965 days.

(21) Appl. No.: 11/717,337

(22) Filed: Mar. 12, 2007

(65) Prior Publication Data

US 2008/0028662 A1 Feb. 7, 2008

Related U.S. Application Data

(60) Provisional application No. 60/781,440, filed on Mar. 11, 2006.

(51) Int. Cl.
*F41C 23/14* (2006.01)

(52) U.S. Cl. ..... 42/73

(58) Field of Classification Search ..... 42/71.01, 42/72, 73, 74, 75.03

See application file for complete search history.

(56) References Cited

U.S. PATENT DOCUMENTS

| | | | | | |
|---|---|---|---|---|---|
| 0,746,859 | A | | 11/1902 | Marble | |
| 1,266,024 | A | | 5/1918 | Kennedy | |
| 1,489,677 | A | | 4/1923 | Stampfli | |
| 2,066,218 | A | * | 12/1936 | Morgan | 42/73 |
| 2,298,678 | A | | 3/1941 | Chase | |
| 2,432,519 | A | * | 12/1947 | Garand | 42/71.01 |
| 2,667,005 | A | | 9/1950 | Weis | |
| 2,787,855 | A | * | 4/1957 | Guymon | 42/73 |
| 2,952,088 | A | * | 9/1960 | Ivy | 42/16 |
| 3,267,601 | A | | 8/1966 | Roy | |
| 3,324,588 | A | * | 6/1967 | Gilbert | 42/71.01 |
| 3,348,328 | A | | 10/1967 | Roy | |
| 3,442,042 | A | * | 5/1969 | Gilbert | 42/73 |
| 3,618,248 | A | | 11/1971 | Into | |
| 3,638,344 | A | | 2/1972 | Wagner | |
| 3,710,496 | A | * | 1/1973 | Packmayr et al. | 42/71.01 |
| 4,122,623 | A | | 10/1978 | Stice | |
| 4,296,566 | A | * | 10/1981 | Campos | 42/71.01 |
| 4,422,256 | A | * | 12/1983 | Maucher et al. | 42/73 |
| 4,512,101 | A | | 4/1985 | Waterman | |
| 4,589,219 | A | * | 5/1986 | Milliman | 42/73 |
| 4,663,877 | A | * | 5/1987 | Bragg | 42/74 |
| 4,697,367 | A | | 10/1987 | Brophy | |
| H000486 | H | * | 7/1988 | Savioli | 42/73 |
| 4,896,446 | A | * | 1/1990 | Gregory | 42/73 |
| 5,001,855 | A | * | 3/1991 | Griggs | 42/74 |
| 5,009,021 | A | * | 4/1991 | Nelson | 42/73 |
| 5,031,348 | A | * | 7/1991 | Carey | 42/74 |
| 5,068,991 | A | | 12/1991 | Reed | |
| 5,075,995 | A | * | 12/1991 | Kennel | 42/73 |

(Continued)

FOREIGN PATENT DOCUMENTS

DE 3812815 A1 * 11/1989

*Primary Examiner* — Troy Chambers

(74) *Attorney, Agent, or Firm* — Faier & Faier P.C.; Martin Faier; James M. Faier

(57) ABSTRACT

A butt stock for a shoulder held firearm with an horizontally and vertically adjustable cheek rest, reversibility of the cheek rest without loss of any of the other adjustments, a shoulder pad assembly to allow from 0 to 360 degrees of adjustment of the angle of the shoulder pad to the rest of the shoulder held firearm, an adjustable length of pull, and a butt stock body that could function as a cheek rest even if the adjustable cheek rest were to be disconnected.

9 Claims, 2 Drawing Sheets

U.S. PATENT DOCUMENTS

| | | | | |
|---|---|---|---|---|
| 5,225,613 | A | 7/1993 | Claridge | |
| 5,392,553 | A * | 2/1995 | Carey | 42/73 |
| 5,711,102 | A * | 1/1998 | Plaster et al. | 42/71.01 |
| 5,755,055 | A | 5/1998 | Thompson | |
| 5,924,233 | A | 7/1999 | Strobel | |
| 5,970,642 | A * | 10/1999 | Martin | 42/73 |
| 6,164,003 | A | 12/2000 | Miller | |
| 6,418,656 | B1 | 7/2002 | Christiansen | |
| 6,497,064 | B1 | 12/2002 | Keaton | |
| 6,536,152 | B1 | 3/2003 | Wisz | |
| 6,543,172 | B1 | 4/2003 | Armstrong | |
| 6,560,911 | B2 | 5/2003 | Sharp | |
| 6,807,763 | B1 | 10/2004 | Leung | |
| 6,829,855 | B2 | 12/2004 | Seifert | |
| 6,874,267 | B2 | 4/2005 | Fitzpatrick | |
| 6,925,744 | B2 | 8/2005 | Kincel | |
| 7,104,002 | B2 * | 9/2006 | Rotundo | 42/73 |
| 7,356,958 | B2 * | 4/2008 | Weir | 42/69.01 |
| 7,640,688 | B2 * | 1/2010 | Oz | 42/73 |
| 2003/0221352 | A1 | 12/2003 | Steele | |
| 2006/0048424 | A1 * | 3/2006 | Weir | 42/69.01 |
| 2007/0056202 | A1 * | 3/2007 | Oz | 42/94 |
| 2007/0289190 | A1 * | 12/2007 | Oz | 42/73 |

* cited by examiner

ADJUSTABLE BUTT STOCK

That the undersigned, Dick Abraham, a resident of Crystal Lake in the State of Illnois, has invented a certain new and useful improvement in a

ADJUSTABLE BUTT STOCK for which the following constitutes his U.S. patent application that claims priority from United States Provisional Application Serial Number 60/781,440 filed 11 Mar. 2006, describing his said invention as follows:

ADJUSTABLE BUTT STOCK

BACKGROUND AND SUMMARY OF THE INVENTION

The present invention relates to gun stocks used with shoulder-fired weapons.

Since the advent of shoulder-fired weaponry, such as guns, the use of a stock for holding the barrel and firing mechanisms of the weapon has been a standard practice. Typically, a stock made of wood, plastic, or metal extended rearward from the firing mechanism some finite distance creating the "gun butt" or "butt stock" portion. This butt stock portion was used to stabilize the weapon. The user would press the butt stock into his or her shoulder while taking aim and firing the weapon.

Standard rifles and other shoulder-fired weapons customarily have stocks with a butt portion located a particular distance from the trigger. That distance is termed "pull length" or "length of pull." The length of pull of most rifles is based on the arm length of a typical user. Problems may arise when the user's size varies from the typical user. With a smaller than typical user, the distance to the trigger is too great when the rifle is braced properly on the shoulder. Variation from correct fit results in increased likelihood of unsafe and inaccurate operation of the weapon.

An adjustable butt stock addresses the problem of variance from typical length of pull. There are various collapsible style butt stocks (U.S. Pat. Nos. 2,462,091; 3,256,632; 3,618,249; 5,305,539) and telescoping style butt stocks (U.S. Pat. Nos. 3,570,162 and 6,560,911). These butt stocks either fail to address all length of pull needs as they adjust only in steps or they limit other shoulder pad adjustments because the length of pull adjustment uses more than a single support running from the receiver to the shoulder pad. With more than a single support, the user may not pivot the shoulder pad out of the forward-rearward axis. The forward-rearward axis is a conceptual line running rearward from the flash hider, through the barrel, the receiver, and out the back of the butt stock. Typically, the shoulder pad on a butt stock has a concavity where the shoulder pad is intended to rest against the shoulder of the user. The shoulder pad has a concavity to help the user keep the butt stock against the shoulder. A user could speak of the radius from the forward-rearward axis to the center of the concavity of the shoulder pad. For reasons of comfort and accuracy a user might desire a shoulder pad adjustment transverse to the forward-rearward axis. A user might also want to adjust the radius from the forward-rearward axis to the center of the concavity of the shoulder pad. The present invention addresses these and other needs.

The present invention finds particular application in conjunction with firearms, such as a Fusil Automatique Leger rifle, commonly known as a FAL rifle. However, the present invention may be used on many other shoulder fired weapons of various types, makes and models. Therefore, this disclosure should not be construed as a limitation of the present invention to any specific rifle application.

From the early days of firearm history, gunsmiths designed the butt stock to provide for comfortable and secure holding of the shoulder-fired weapon during use. Many butt stocks took a traditional butt stock and added storage compartments. At the same time, the number of appliances that a user might wish to attach to his or her rifle has mushroomed to include sights, telescopic sights, lights, sensors, beacons, radios, global positioning devices, and more. To accommodate those additional appliances, gunsmiths incorporated various methods of adhering those appliances to the shoulder-fired weapon. Along the top of the shoulder-fired weapon, manufacturers added rail systems to which the appliances might be attached.

With advances in the quality of shoulder-fired weapons, the need for butt stock storage of maintenance equipment was reduced. Many modern shoulder-fired weapons have no storage in the butt stock.

Currently, the United States government and other western countries use a variation of the ARMALITE Rifle, model number 15, known as the AR15. In the United States arsenal, the improved version of the AR15 is the U.S. rifle Model 16, known as the M16. Also used in the U.S. arsenal is a carbine rifle using the AR15 characteristics but in a shorter form. This carbine is known as the U.S. carbine Model No. 4, known as the M4.

The M16 has a trap door in the butt stock for the rifle's cleaning kit.

The M4 carbine has no compartment in the butt stock. The M4 has a smaller butt stock that is collapsible making the firearm's overall length smaller. Making a firearm smaller is beneficial to help the shooter move safely and comfortably in confined areas. The M4 butt stock is not only collapsible, but also includes various intermediate extended positions providing for an adjustable overall length of the firearm. The M4's butt stock telescopes along the carbine's receiver extension that protrudes from the rear of the carbine. The M4 butt stock may lock onto the receiver extension in positions providing adjustable length. The multiplicity of adjustments helps various sized users by helping the user to use the firearm. The multiplicity of adjustments also helps the use in shoulder mounting the firearm over gear and in any condition in which the user may find himself or herself.

The M4 collapsible stock may be too short, even where fully extended, and, as a result, uncomfortable against the face of a user on the cheek rest. Current military butt stocks, in both the rifle and carbine configurations, require little from butt stock design. As such, other than comfort and strength, the butt stock has few other requirements.

Since the earliest shoulder-fired firearms, the butt stock existed to support the user in aiming the weapon, to transfer recoil force from the weapon to the shoulder of the user, and to aid in the comfort of the user.

Modern combat firearms require a platform for a variety of appliances. Manufacturers developed mounting platforms to retrofit to existing firearms. Also, manufacturers developed an integral mounting surface into the firearm's construction. Initially, these mounting platforms were located near the muzzle end of the firearm and had the ability to mount a number of accessories, such as lighting systems, night vision hardware, thermal imaging systems, surveillance equipment and hardware to aid the user in achieving the best accuracy possible. More recently, those platforms have been added to the length of the firearm to accommodate more appliances.

The addition of appliances has created some problems. The area for placement of mounting hardware is limited. The mounting of platforms at the muzzle end left the muzzle uncomfortably heavy. More weight on the muzzle can make aiming more difficult as the rifle is more difficult to raise, take aim, and keep the target in the sight through firing. The appliances may require connections to equipment off the rifle to function. The appliance can be too large or complex to mount solely to the muzzle end of the firearm. The component may need to be dispersed throughout the rifle to balance the weight across the rifle. In sum, having additional locations for appliances is advantageous to assure users of places for important appliances while balancing weight and other conditions.

A disadvantage of the storage butt stocks is that they are necessarily larger so as to provide storage space. The large size goes against the goal of having a small weapon that can be taken through tight environments. Often times a storage area will add noise to the weapon. Imagine a butt stock with storage for batteries or bullets. Assuming that they are not tightly packed, the butt stock might well rattle. In a dangerous condition where the user is surrounded by enemies, the noise from the material in the butt stock could reveal the user's location and result in great harm. Where the user is hunting, the additional noise could scare away his or her prey.

On occasion, pieces are lost off of a rifle so the preferred embodiment has contoured side edges which may be used as a comfortable cheek rest even where the cheek rest is missing.

OBJECT AND ADVANTAGES OF THE INVENTION

An object of the invention is to provide a user with a butt stock with a horizontally and vertically adjustable cheek rest.

Another object of the invention is to provide a user with a butt stock where the user can adjust the length of pull.

Another object of the invention is to provide a user with a butt stock where the user can adjust the angle of the shoulder pad to the vertical plane of the firearm body and grip to accommodate a user desiring to hold the rifle and grip on an angle outside of the typical vertical plane while bracing the rifle with the shoulder pad square against the shoulder.

Another object of the invention is to enable the user to lengthen the shoulder pad on the butt stock through use of a shoulder pad extension feature so that a user may direct force as desired and can adjust the extension plate to provide for more options or combine the extension feature with the rotation feature of the shoulder rest.

Another object of the invention is to provide user with a butt stock with a fully reversible cheek rest for right and left handed users where both types of users have access to all the other adjustable features of the butt stock.

Another object of the invention is to provide user with a butt stock with an industry standard rail assembly for mounting appliances at the bottom of butt stock and balance such appliances against appliances mounted in a forward portion of the firearm.

Another object of the invention is to provide a butt stock with all the aforementioned adjustment features and with the option of a paratrooper mount so that the user could fold the butt stock upon the receiver of the rifle.

Another object of the invention is to provide a butt stock with a curved bottom that allows for the appliance rail but reduces the likelihood of catching the rifle on clothes and other hazards.

Another object of the invention is to provide a butt stock with an angled cheek rest for greater comfort while in use.

Another object of the invention is to provide a contoured edge on the top and each face of the butt stock so that a user could comfortably use the butt stock even with the cheek rest and adjustment parts removed.

Another object of the invention is to provide an adjustable butt stock that is easy to use, easy to make, and expedient.

These and other objects and advantages will become more apparent as this description proceeds, taken in conjunction with the accompanying drawings.

DESCRIPTION OF THE PREFERRED EMBODIMENT

Figure 1:
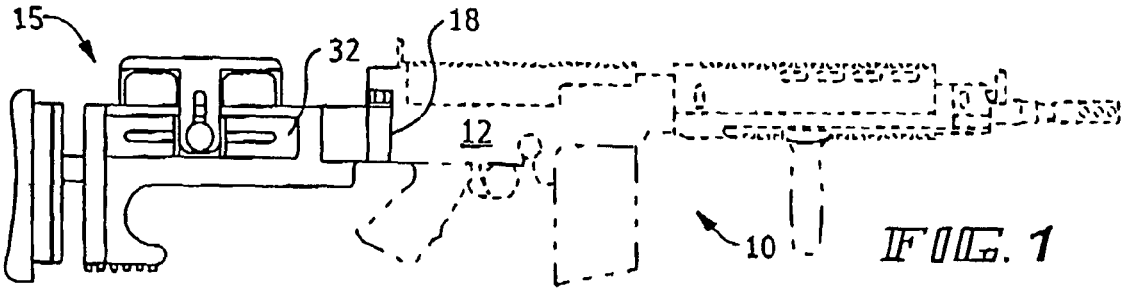
FIG. 1 is a right side elevational view of a FAL rifle, showing the muzzle and barrel in dotted lines and showing an embodiment of the adjustable butt stock embodying the invention.

With reference to the accompanying drawings, the adjustable butt stock 15 embodying the present invention is mounted to a FAL rifle 10 as shown. This adjustable butt stock 15 is screwed to the receiver lower 12 through a paratrooper pivot hinge plate (not shown) of the paratrooper pivot hinge 20. The paratrooper pivot hinge rotates about the paratrooper pivot hinge pin 22. The butt stock body 25 connects to the paratroop pivot hinge plate (not shown) at the paratrooper pivot hinge pin 22. The butt stock body 25 extends rearward. The horizontal cheek adjustment recess 32 extends rearward on both the right and left elevations of the butt stock body 25. The horizontal cheek adjustment recess 32 has a cheek adjustment channel 30, that comprises a slot in the middle of the horizontal cheek adjustment recess 32. The cheek rest 50 is mounted on the butt stock body 25. The cheek rest 50 is reversible. When the cheek rest 50 is mounted on the left side of the butt stock body 25, the cheek rest adjustment knob 40 is threaded through the rear of the cheek rest 50 at the vertical cheek adjustment channel 45 on the right side of the butt stock body 25 through the external cheek rest adjustment pad 115 through the horizontal cheek rest adjustment channel 30 and threading into the internal cheek rest adjustment pad 125 and is tightened in the desired position horizontally and vertically by the user. Both the external cheek adjustment pad 115 and the internal cheek adjustment pad 125 have rounded bottoms that fit closely but slide easily in the horizontal cheek adjustment recess. The external cheek adjustment pad 115 has raised edges that guide the back of the cheek rest 50 and center the vertical cheek adjustment channel 45 on the aperture in the external cheek adjustment pad 115 for ease of placement of the cheek rest adjustment knob 40. When the user desires to reverse the cheek pad 50 to that it faces the right side of the butt stock body 25, then the user must unscrew the cheek rest adjustment knob 40 from the internal cheek rest adjustment pad 125, pull out the cheek adjustment knob 40 from the horizontal cheek adjustment channel 30 then from the external cheek adjustment pad 115 and finally from the vertical cheek adjustment channel 45. Then the user would put the cheek rest 50 and the aforementioned pieces on the other side in always with the cheek adjustment knob 40 going through the vertical cheek adjustment channel 45, then the external cheek adjustment pad 115, then the horizontal cheek adjustment recess 32 and its horizontal cheek adjustment channel 30 and into the internal cheek adjustment pad 125. The top edge 26 of the butt stock body 25 are smooth so that the butt stock body 25 could be used as a comfortable cheek rest should the cheek rest 50 and its associated adjustment pieces were missing.

Length of pull adjustment is achieved by moving the shoulder pad pivot 55 forward or rearward in the shoulder pad pivot channel 35. In the preferred embodiment, the shoulder pad pivot 55 is secured to the shoulder pad base 60 with the shoulder pad base set screw 100. To make the shoulder pad pivot 55 available to move, the user would loosen the grip of the back plate 130 on the shoulder pad pivot 55 by loosening the upper pivot set screw 75 and the lower pivot set screw 80. The user would then move the shoulder pad pivot 55 forward and rearward in the shoulder pad pivot channel 35. Once the desired length of pull is achieved, then the shoulder pad pivot 55 may be locked into position by tightening the upper pivot set screw 75 and the lower pivot set screw 80. To remove the back plate 130 that anchors the shoulder pad pivot 55, the user would removing the upper back plate set screw 85, the middle back plate set screw 90, and the lower back plate set screw 95.

Figure 2:
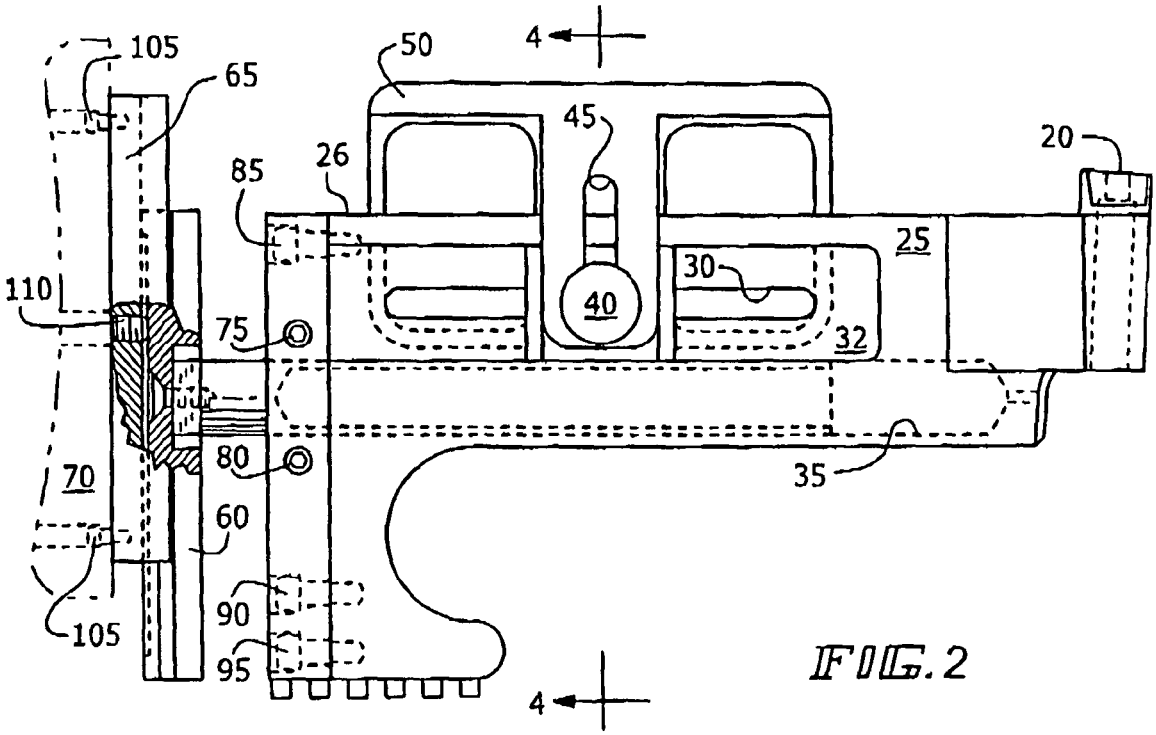
FIG. 2 is an enlarged right side elevation view of an embodiment of the adjustable butt stock.
Figure 3:
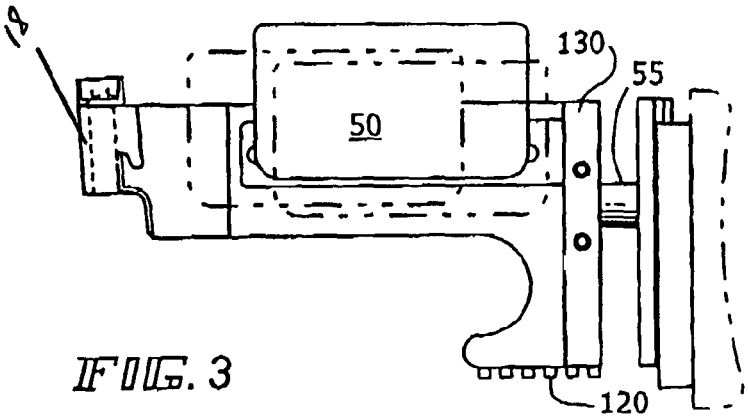
FIG. 3 is an enlarged left side elevation view of an embodiment of the adjustable butt stock.
Figure 4:
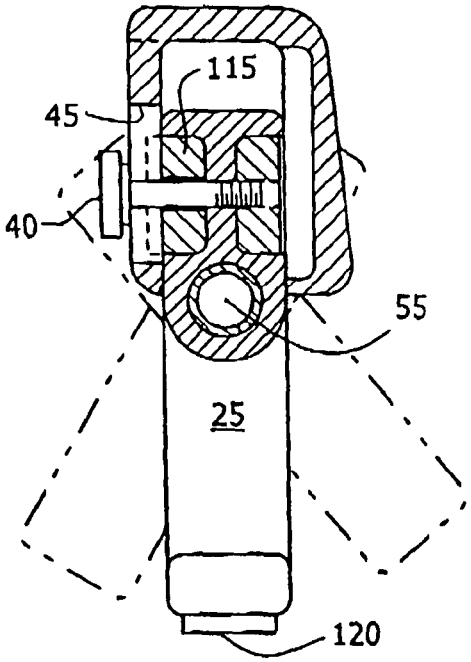
FIG. 4 is a sectional view of an embodiment of the adjustable butt stock, taken along the line 4-4 of FIG. 2 showing the cheek piece on the left side of the adjustable butt stock, and alternative positions of the shoulder pad in dotted lines.
Figure 5:
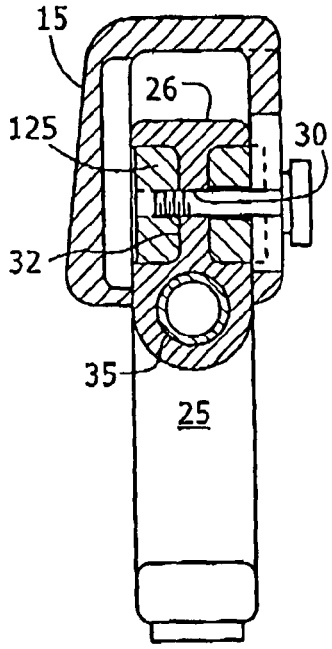
FIG. 5 is a sectional view of an embodiment of the adjustable butt stock, identical to FIG. 4 but with the cheek pad and the cheek adjustment pads reversed from the prior figure.
Figure 6:
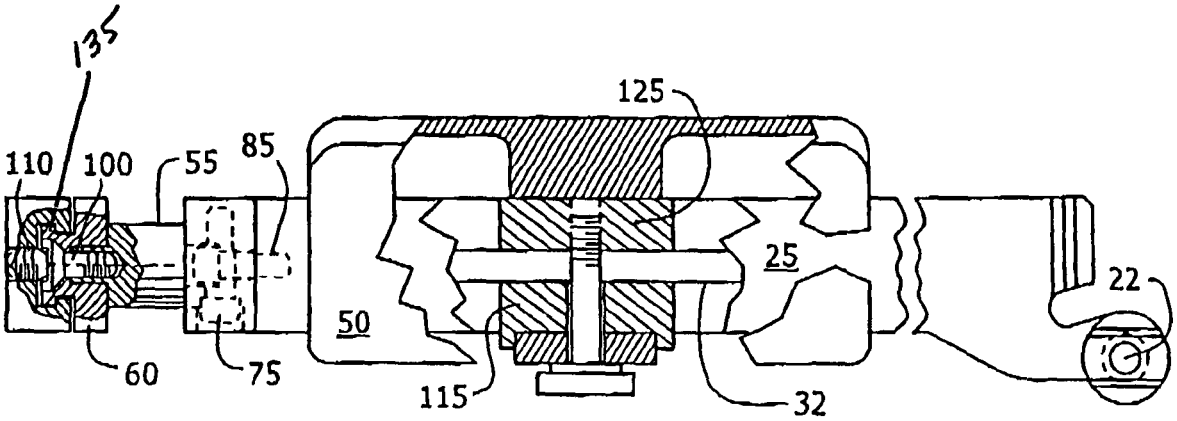
FIG. 6 is a top view of an embodiment of the adjustable butt stock showing a set screw and its environment in section, which keeps the cheek pad in position where the horizontal and vertical channels may travel.

To adjust the shoulder pad, the user may adjust the angle of rotation of the shoulder pad pivot 55, as shown in FIG. 4, or the location of the shoulder pad 70, as shown in FIG. 2. To adjust the angle of rotation of the shoulder pad 70, the user would loosen the upper pivot set screw 75 and the lower pivot set screw 80. Upper pivot set screw 75 and lower pivot set screw 80 may be reached through the shoulder pad 70 at the end of the butt stock 15. In the preferred embodiment, there are indentations in should pad 70 for access to upper pivot set screw 75 and lower pivot set screw 80. The user could then rotate the shoulder pad pivot 55 to any point of rotation from 0 to 359 degrees. When the user had the shoulder pad 70 at the desired point of rotation, the user would tighten upper pivot set screw 75 and lower pivot set screw 80.

To adjust the location of the shoulder pad 70, the user would loosen the shoulder pad extension set screw 110 through an indentation in the face of shoulder pad 70 and then move the shoulder pad extension 65 on the shoulder pad extension rail 135 in the shoulder pad base 60 such that the shoulder pad extension 65 was either more or less overlapping the shoulder pad base 60. The less the shoulder pad extension 65 overlaps the shoulder pad base 60, the farther the shoulder pad is off center from the shoulder pad pivot 55. Once the shoulder pad extension 65 is in the desired location, then the user would tighten the shoulder pad extension set screw 110. The shoulder pad may be removed by loosening and removing the shoulder pad set screws 105.

The invention claimed is:

1. In a butt stock for a shoulder-held firearm, said butt stock having:

a cheek rest horizontally and vertically adjustable on said butt stock and said cheek rest being reversible on said butt stock to accommodate both right-handed and left-handed users.

2. A butt stock for a shoulder held firearm comprising:

a butt stock body, a receiver lower, a shoulder pad, a cheek rest, wherein said butt stock body is rearward of said receiver lower with connection means thereto and forward of said shoulder pad with connection means thereto and said cheek rest being horizontally and vertically adjustable on said butt stock body wherein said cheek rest is reversible on said butt stock body for use by right-handed and left-handed users.

3. A butt stock for a shoulder held firearm comprising:

a butt stock body, a receiver lower, a shoulder pad, a cheek rest, wherein said butt stock body is rearward of said receiver lower with connection means thereto and forward of said shoulder pad with connection means thereto and said cheek rest being horizontally and vertically adjustable on said butt stock body wherein said second side rides in a channel for vertical movement with means to lock said second side in a selected position on said body.

4. A butt stock for a shoulder held firearm comprising:

a butt stock body, a receiver lower, a shoulder pad, a cheek rest, wherein said butt stock body is rearward of said receiver lower with connection means thereto and forward of said shoulder pad with connection means thereto and said cheek rest being horizontally and vertically adjustable on said butt stock body wherein said second side rides in a channel for horizontal movement with means to lock said second side in a selected position on said body.

5. The butt stock as claimed in claim 3 or 4 wherein said locking means is comprised of an external cheek rest adjustment pad, an internal cheek rest adjustment pad, a cheek rest adjustment knob, wherein said external cheek rest adjustment pad guides said cheek rest adjustment knob through said second side through said external cheek rest adjustment pad through said body and securing into said internal cheek adjustment pad.

6. A butt stock for a shoulder held firearm comprising:

a butt stock body, a receiver lower, a shoulder pad, a cheek rest, wherein said butt stock body is rearward of said receiver lower with connection means thereto and forward of said shoulder pad with connection means thereto and said cheek rest being horizontally and vertically adjustable on said butt stock body, a cheek rest adjustment knob, an external cheek rest adjustment pad, an internal cheek rest adjustment pad, wherein said cheek rest adjustment knob fits through said vertical cheek adjustment channel, said external cheek rest adjustment pad, said butt stock body, and internal cheek rest adjustment pad with securing means for said cheek rest adjustment knob.

7. The butt stock as claimed in claim 6 wherein said securing means comprise said internal cheek rest adjustment pad receives said cheek rest adjustment knob, each threaded to cooperate with one another.

8. A butt stock for a shoulder held firearm comprising:
a butt stock body,
a receiver lower,
a shoulder pad,
a cheek rest,
wherein said butt stock body is rearward of said receiver lower with connection means thereto and forward of said shoulder pad with connection means thereto and said cheek rest being horizontally and vertically adjustable on said butt stock body,
said butt stock body with a forward end, an intermediate section, a rearward end, a right-side and a
left-side;
a shoulder pad;
a cheek rest;
wherein said forward end of said butt stock body has connection means to a receiver lower and
said rearward end of said butt stock body has connection means to said shoulder pad and
said butt stock body having a right-side horizontal cheek rest adjustment groove,
said butt stock body having a left-side horizontal cheek rest adjustment groove,
said right-side and left-side horizontal cheek rest adjustment grooves approximately opposite one another and a horizontal cheek rest adjustment channel through said,
and within one of said grooves
an external cheek adjustment pad
and within the other of said grooves
an internal cheek adjustment pad
said cheek rest with
a first side having a surface comfortable for a user
a second side with a vertical cheek adjustment channel,
said first and second sides joined so that they may straddle over
a top edge of said butt stock body and down said right-side and left-side of said,
said cheek rest held in place with
a cheek rest adjustment knob that passes through
said vertical adjustment channel then passes through
said external cheek adjustment pad then passes through
said horizontal cheek rest adjustment channel and threading into
said internal cheek adjustment pad.

9. A butt stock for a shoulder-held firearm comprising:
a cheek rest,
a shoulder pad with a center concavity,
a shoulder pad pivot, and,
a butt stock body,
said shoulder pad being adjustable so as to extend the distance from forward - rearward axis to said center concavity,
a shoulder pad extension
wherein said shoulder pad is secured with connecting means to said shoulder pad extension
a shoulder pad base
said shoulder pad extension and said should pad base crafted with a slot such that said extension and said base interlock and may slide one upon the other said shoulder pad extension having a set screw and a channel to lock said extension to said base,
said shoulder pad allows access directly to said set screw through said shoulder pad.

* * * * *